US005101567A

United States Patent [19]

Cool

[11] Patent Number: 5,101,567

[45] Date of Patent: Apr. 7, 1992

[54] CHAIN SAW ELECTRIC ALL-STOP SAFETY SWITCH

[76] Inventor: James E. Cool, 878 Cleveland Ave. S., Mogadore, Ohio 44260

[21] Appl. No.: 722,159

[22] Filed: Jun. 27, 1991

[51] Int. Cl.[5] ..... B27B 17/02; B27G 19/00

[52] U.S. Cl. ..... 30/382; 30/383; 200/61.85; 83/DIG. 1

[58] Field of Search ..... 30/381, 382, 383, 384, 30/385, 386, 387, 390; 83/DIG. 1; 200/43.17, 43.18, 61.85, 239, 345, 530, 534

[56] References Cited

U.S. PATENT DOCUMENTS

| | | | |
|---|---|---|---|
| 3,131,277 | 4/1964 | Brenzen | 30/382 X |
| 3,664,390 | 5/1972 | Mattsson et al. | 30/381 |
| 3,967,085 | 6/1976 | Lockard et al. | 200/345 X |
| 4,335,514 | 6/1982 | Overy et al. | 30/382 |
| 4,426,563 | 1/1984 | Grogan | 30/383 X |
| 4,811,487 | 3/1989 | Takahashi et al. | 30/382 |

*Primary Examiner*—Hien H. Phan
*Assistant Examiner*—Raymond D. Woods
*Attorney, Agent, or Firm*—Paul E. Milliken; Lee A. Germain

[57] ABSTRACT

A chain saw safety switch mounted in combination with a chain braking mechanism such that, when chain braking is initiated, both the chain motion about a chain guide bar and motor operation are automatically stopped. The safety switch according to one embodiment of the invention is mounted to the safety guard of the chain braking mechanism in a position such that it may be rendered operable by either a selective action of the saw operator or by the operator's reaction response to a hazardous operating condition. In either case, the safety switch effects short-circuiting of the motor ignition to stop all motor operation while at the same instant, the safety guard effects stoppage of the cutting chain motion about the chain guide bar. Alternatively, the safety switch is mounted in conjunction with the movable safety guard such that short-circuiting of the motor ignition is effected through the chain braking mechanism.

17 Claims, 3 Drawing Sheets

FIG.-5
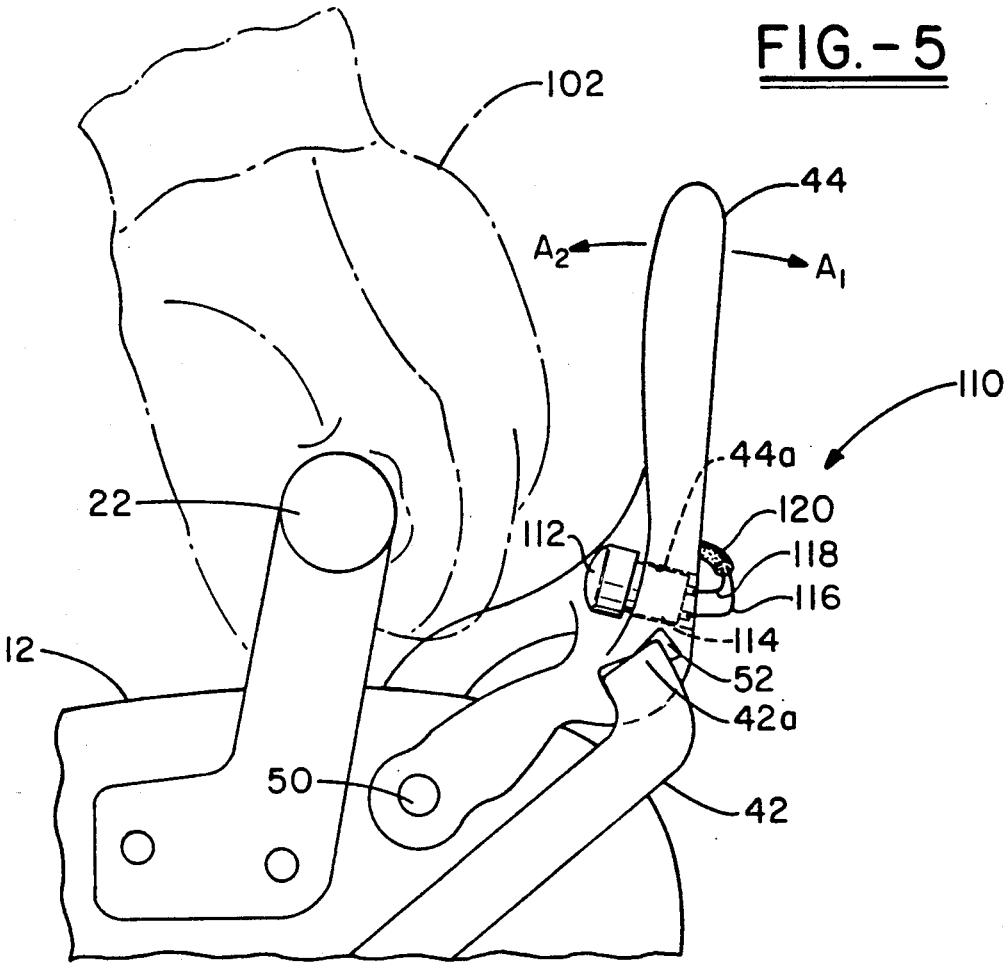
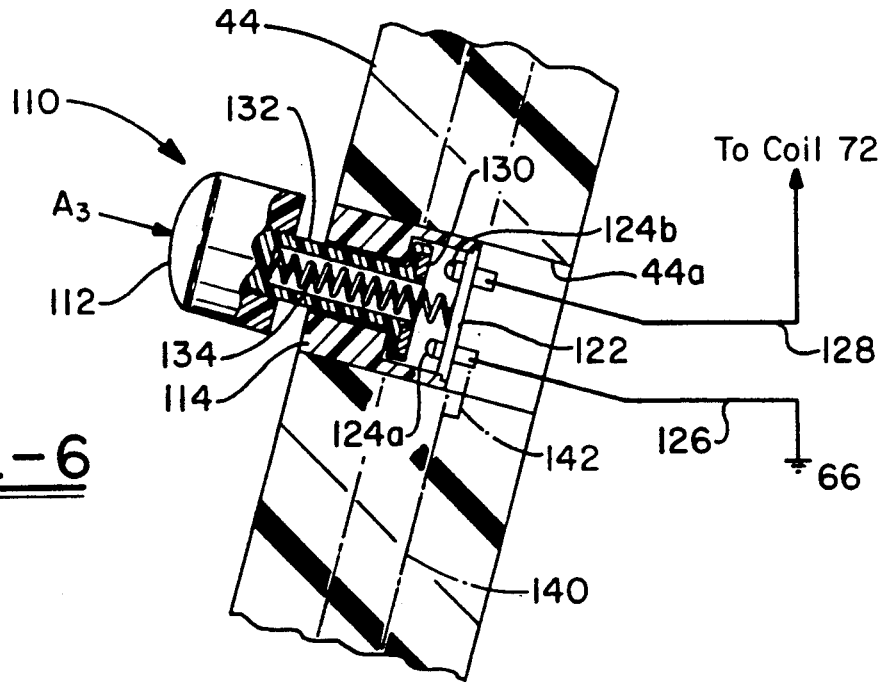
FIG.-6

CHAIN SAW ELECTRIC ALL-STOP SAFETY SWITCH

TECHNICAL FIELD OF THE INVENTION

The field of invention relates generally to power chain saws and, more particularly, to safety devices as may be applied to gasoline-powered chain saws.

More specifically, the present invention pertains to an electrical safety switch adapted to operate in conjunction with and/or simultaneously with a chain brake mechanism to shut down the motor drive function when the chain brake is energized.

BACKGROUND OF THE INVENTION

Since the first introduction of the power chain saw various types of safety devices have been added to the tool to help insure against injury to the tool operator. Tool kickback is an inherent hazard in the operation of this type of power tool and kickback may occur when the tip end of the cutting chain, which is mounted about a chain guide bar, comes in contact with an object not cutable by the chain and/or by a pinching action of the guide bar during a cutting operation. Both of these operational conditions cause reaction forces which may result in the operator losing control of the tool and this posses a hazard and a very real danger to the operator.

Power chain saws have conventionally included a pair of handle controls each of which is gripped by the operator to control the tool. A rearward handle includes various switches and/or button controls which function to operate the saw motor. A top handle is mounted and positioned such that the operator may grip it to maintain directional control over the tip end of the saw. When the cutting chain is stopped momentarily by an uncutable object in its path and/or the tip end of the guide bar is pinched, the reaction force of the cutting chain causes a rotation of the saw in a direction opposite to the chain movement about the guide bar. This reaction force may effect a movement of the chain guide bar up and back in an uncontrolled arc which is mainly in the plane of the guide bar. Under some operating conditions, the guide bar may move in an arc toward the operator who must have decisive control of the tool by way of the rear and top handles.

In light of the chain saw kickback hazard, various type of chain brake devices have been suggested and/or added to the tool such as to automatically stop cutting chain motion about the guide bar when kickback occurs. Chain brake mechanisms of the type alluded to have taken the form of a band brake which operates in conjunction with the motor drive hub which includes a clutch and sprocket of the chain drive. The band brake is tightened about the peripheral extent of the hub by a forward movement of the saw top handle or, by a forward movement of a safety guard which may be mounted in a relative position to the top handle when such are provided art as exemplified in U.S. Pat. Nos. 4,077,125; 4,335,514; 4,426,563; 4,586,588; and 5,882,844.

In addition to a chain braking device, it has been suggested that motor shut-down at the time of chain brake engagement would also be a beneficial safety advantage in the operation of these type power tools. In this respect, a mechanical linkage is disclosed in U.S. Pat. No. 4,426,563 which operates in conjunction with the saw top handle and the motor on/off switch such that, when saw kickback occurs, a rotation of the top handle effects motor shut-down by a reactive movement of the linkage. U.S. Pat. No. 4,335,514 also discloses a connecting link element which communicates with the saw top handle and the motor on/off switch such that any occurrence of saw kickback will automatically move the switch to the motor "off" position. This is obviously necessary when the chain saw is powered by an electric motor. In addition to these prior art teachings, U.S. Pat. No. 4,882,844 discloses a chain brake device which operates in conjunction with an electrical solenoid which automatically enables the chain brake when the saw trigger control is released.

Mechanical linkages of the type taught by the prior art obviously require a redesign and/or a re-arrangement of the conventional parts which may be found in presently available power chain saws Furthermore, any of the earlier designed chain saws which are being used in the field will require an alteration and/or modification to accommodate these additional mechanical arrangements. However, such modifications to existing saws may jeopardize any warranty rights in the tool when not specifically authorized by the saw manufacturer.

Thus, there is an obvious need in the art for a power chain saw all-stop safety device which is fool-proof, easily adapted to presently designed saws and, which requires very little or no modification to those chain saws already being used in the field. Further, there is a need in the art for a power chain saw safety device which is low in cost and which effectively produces motor shut-down almost instantaneously when chain brake engagement is made.

SUMMARY OF THE INVENTION

This invention provides a safety switch for a chain saw having a gasoline-powered motor driving a cutting chain about a guide bar through a shaft-mounted sprocket hub, the motor having a housing and spark generating means which receives an electrical current from a current generating means, the safety switch being mounted in combination with a chain brake mechanism having a brake actuation lever interconnecting a movable safety guard at one end with a chain braking device at the other end, the brake lever being movable to and from brake release and engage positions in response to backward and forward movements of the safety guard, the safety switch being normally in an open-circuited condition and rendered close-circuited in response to the movement of the safety guard and having electrical conductor means interconnecting the current generating means to the motor housing when close-circuited to provide an electrical ground short to the motor housing to shut down the motor when the chain brake is moved to the brake engage position by the safety guard.

BRIEF DESCRIPTION OF THE DRAWINGS

The various features and advantages of the present invention will best be appreciated and understood from a consideration of the detailed description which follows when taken in conjunction with the accompanying drawings, in the several figures in which like-reference numerals are used to identify like elements and wherein:

FIG. 5 is a greatly enlarged side elevational view of the top handle portion and safety guard for chain brake engagement and illustrating another embodiment of the invention; and FIG. 6 is an enlarged side elevational view, in cross-section, of the switch means illustrated in FIG. 5.

DETAILED DESCRIPTION OF THE INVENTION

Figure 1:
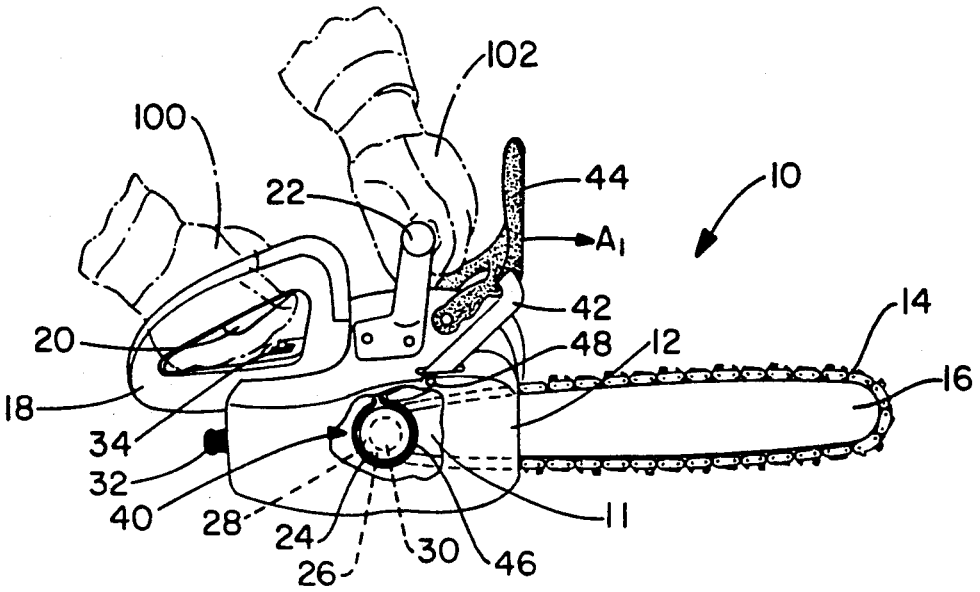
FIG.-1 Prior Art
FIG. 1 is a perspective view of a prior art power chain saw, with portions being broken away to show internal parts and to illustrate the manner of its operation, the saw being a state-of-the-art gasoline-powered type which benefits from the present inventive concept.

Referring to FIG. 1 of the drawings, a power chain saw is generally indicated by reference numeral 10 as it may be manipulated by an operator (not shown) whose hands 100 and 102 control the operation of the saw. The chain saw 10 is characterized by a gasoline-powered 2-cycle motor 11 mounted within a housing 12 and it drives a cutting chain 14 about a chain guide bar 16 in a conventional and well-known manner. The saw 10 is further characterized by a rearwardly extending handle 18 which includes at least one motor control lever or button 20 which is mounted within the handle such that the operator's hand 100 may grip the handle while also operating the motor function. The chain saw 10 also has a top handle 22 which is mounted in a stationary manner to the motor 11 or to the housing 12 and it is gripped by the operator's other hand 102. The showing of FIG. 1 illustrates chain saw operation by a right-handed operator and it may be appreciated that the saw is under full control of the operator in that the right hand 100 controls saw motor function while both right and left hands 100 and 102 may be used to control positioning of the forward cutting chain and chain guide bar in the upward, downward, forward, backward, and sideward motions.

The cutting chain 14 is driven about the guide bar 16 by the motor 11 through a sprocket hub 24 which also carries a clutch mechanism 26 within a recessed annular cavity about a central bore 28 which is splinned to the motor drive shaft 30. This is, of course, a well-known chain saw configuration.

In the operation of the chain saw 10, a fuel mixture is fed to a piston cylinder in the conventional manner of such 2-cycle engines. The fuel is fired by a spark plug 32 which receives an electrical current from a magneto through a coil. The sprocket hub 24 is driven into rotation and thus also the cutting chain 14 about the chain guide bar 16. An on/off switch 34 provides a ground connection such that, in the "off" position, current normally being fed to the spark plug 32 is shunted to the ground potential and the motor 11 is shut down. In the "on" position of the switch 34, the ground connection is "open-circuited" and the current is supplied to the spark plug 32 for normal operation of the motor 11.

The chain saw 10 illustrated in FIG. 1 is also provided with a chain brake mechanism generally indicated at reference numeral 40 and it is characterized by a brake lever 42 which interconnects a safety guard 44 with a brake band 46 operatively positioned about the sprocket hub 24. The brake lever 42 is mounted for rotation about a pin 48 and it can be appreciated that a rotation of the lever 42 by reason of a forward movement of the safety guard 44 in the direction of arrow Al will effect band braking action on the sprocket hub 24.

Figure 2:
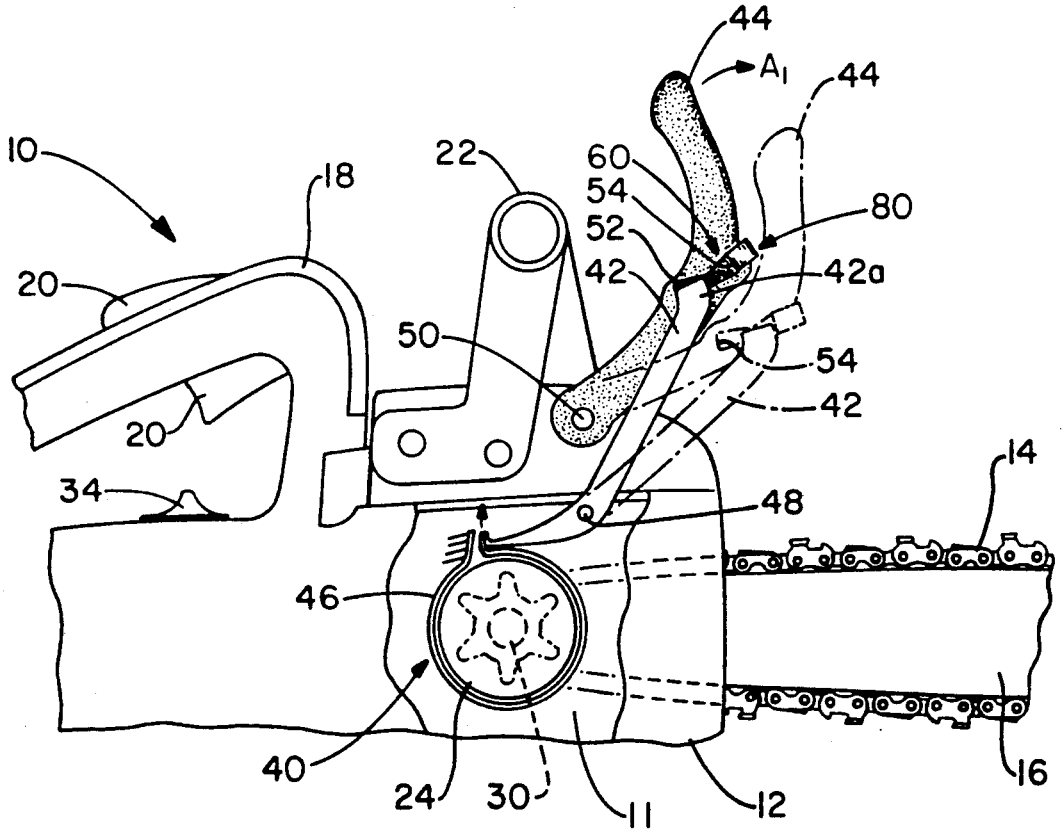
FIG. 2 is a side elevational view of the saw of FIG. 1 with portions being broken away to show internal elements and to illustrate the application of the present invention.

Referring now to FIG. 2 of the drawings, the specifics of the chain brake mechanism 40 will be more apparent. The safety guard 44 is mounted for rotation about a pin axis 50 carried within the saw housing 12 while the brake lever 42 is mounted for rotation about a pin axis 48 which is also carried within the saw housing 12. The mounting pins 48 and 50 may actually be mounted to flanges (not shown) which are formed as part of the motor housing. The safety guard 44 and brake lever 42 are interconnected at 60 by way of a recess 52 within the material forming the side of the guard 44 and a bent portion **42*a* of the brake lever 42 which rides within the recess 52. Because the safety guard 44 and brake lever 42 have different axes of rotation 50 and 48 respectively, the recess 52 is shaped such that the end 42*a* of the lever may exhibit a rocker type action within the recess. Thus, the ends 54 of the recess 52 are wider than at the midpoint to accommodate the action of the brake lever 42. From this it should be apparent that, when the safety guard 44 is in the "brake off" or disengaged position as shown in FIG. 2, the lever 42 makes contacting engagement with the rear end of the recess 52 and a gap exists between the forward end of the lever and the forward end of the recess. Alternatively, when the safety guard 44 is moved to the "brake on" or engaged position as indicated by the dot-dashed ghost lines, the forward end of the lever 42 makes contacting engagement with the forward end of the recess 52 and a gap exists between the rearward end of the lever 42 and the rearward end of the recess 52**.

It was recognized by this inventor that, because of the particular operational arrangement of the safety guard 44 and the brake lever 42 and also by the fact that the brake band 46 is grounded through the hub 24 and the motor drive shaft 30 interactions, an opportunity exists for configuring a safety motor switch which would be immediately responsive to a brake band engagement with the sprocket hub 24 Such a switch means could be instantaneously connected to a ground potential with reference to an electrical coil which feeds electrical current to the spark plug 32 the instant that the brake lever 42 is moved to the "brake engage" position about the drive sprocket 24 and this would shut down all motor operation. That this is so may be appreciated from a consideration of FIG. 3 of the drawings.

Figure 3:
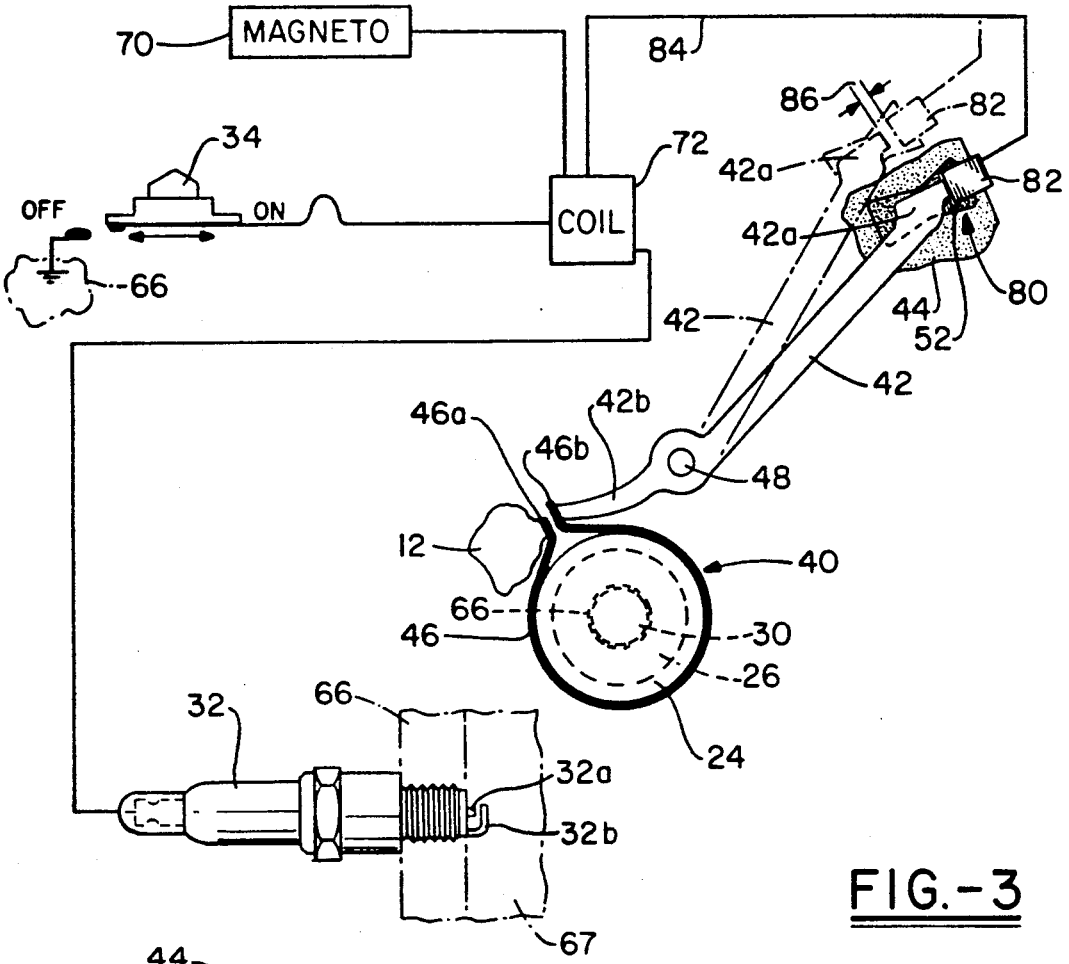
FIG. 3 schematically illustrates the application of the invention to a 2-cycle gasoline-powered chain saw having a kickback reaction-operated chain brake mechanism.

FIG. 3 schematically illustrates the electrical requirements for the operation of a 2-cycle gasoline-powered motor 11. The chain saw motor 11 will have a magneto 70 which generates an electrical current in a well-known and understood manner. The current is fed to a spark plug 32 through a coil 72 and a spark is generated between a center plug electrode **32*a* and a grounded plug electrode 32*b* by reason of the spark plug threaded connection into the motor housing indicated at reference numeral 66. Obviously, fuel fed into the motor combustion chamber 67 explodes by action of the spark plug 32 and this is, of course, a well-known 2-cycle motor operation as such have been in existence for a long time. As shown in the drawing, the spark plug electrode 32*b* is grounded to the motor housing 66 and it is a well known fact that, when the top end of the pug 32 is grounded to the motor housing by means of a metal conductor, all motor operation ceases because no electrical current may reach the spark plug electrodes 32***a*, 32*b* within the combustion chamber 67 Accordingly, motors of this type may include an on/off switch 34 which has one side connected into the coil 72 and the opposite side connected to ground potential with respect to the coil, i.e., to the motor housing 66. When the switch 34 is in the "on" position as shown in the drawing, current from the magneto 70 will be passed through the coil 72 and to the spark plug 32 for normal operation of the motor. However, when the switch 34 is moved to the "off" position, the coil is grounded to the motor housing 66 and motor operation will cease.

Further with reference to FIG. 3, the chain brake mechanism 40 is shown as it comprises a brake band 46 having one of its ends 46*a* fixedly attached to a stationary member of the saw housing 12 while the opposite end 46*b* is connected to a rotatable end 42*b* of the brake lever 42. It was recognized by this inventor that, when the brake band 46 is operatively engaged with the chain drive sprocket hub 24, an electrical ground connection exists as between the metal-to-metal contact of the brake band and sprocket hub and the motor housing 66 by way of the drive shaft 30 and drive hub mounting. Thus, a complete electrical circuit exists through the chain brake 40 to the spark plug grounded connection which is the motor housing 66.

In accordance with the foregoing, the inventor installed a switch means generally indicated in the drawing at reference numeral 80 which is advantageously positioned within the recess cavity 52 of the safety guard 44 and brake lever 42 interconnection. A switch contact 82 comprised of an electrically conductive material such as, for example, a short length of copper bar stock may be positioned within the forward end of the recess 52 and bent to a U-shape configuration about the forward end of the safety guard 44. The terminal end of the switch contact 82 that is outside of the recess 52 is connected to the coil 72 via a wire conductor 84. The switch contact 82 is characterized by a gauge thickness within the recess 52 such that a gap 86 still exists as between the forward end of the brake lever 42*a* and the switch contact 82. Thus and as illustrated by the dot-dashed ghost-line showing in the drawing, when the brake lever 42 is in the brake "disengage" position the coil 72 cannot be grounded through the brake band connection with the sprocket hub 24. However, and as illustrated by the solid line showing, when the brake lever 42 is moved to the brake "engage" position about the sprocket hub 24, an electrical contact is made as between the forward end of the lever 42*a* and the switch contact 82. In this position of the brake lever 42, an electrical ground connection exists from the coil 72 to the motor housing 66, and this, through the chain brake mechanism 40.

From the foregoing description it has been shown that, irrespective of the position of the on/off switch 34 which may not always be accessible to the saw operator when a kickback situation occurs, immediate motor shut-down may be effected by the switch means 80 of the present invention.

It should be pointed out here that the switch means 80 as illustrated in FIG. 3 presents an advantageous safety for professional wood cutters as these keep their chain saw tools in perfect working condition on a day-to-day basis. Presently available chain saws are equipped with a clutch 26 which is designed to prevent chain motion about the chain guard 16 when the saw motor 11 is at a predetermined idling speed It should be further pointed out here that chain saw manufacturers recommend that the operator engage the safety chain brake 40 whenever the saw is being started from a stopped condition. This is a recommended safety practice as the motor operation at start-up may be erratic and the cutting chain 14 should not be in motion at this time. This is not a problem for the professional because his equipment will be kept at top operating condition and for most start-ups the motor will rapidly reach idle speed and the clutch will prevent chain motion. However, for the average consumer who may only use the chain saw at irregular intervals, it is recommended that engaging the safety chain brake 40 should be the standard procedure for all motor starts, and this, to prevent any type of accident.

Figure 4:
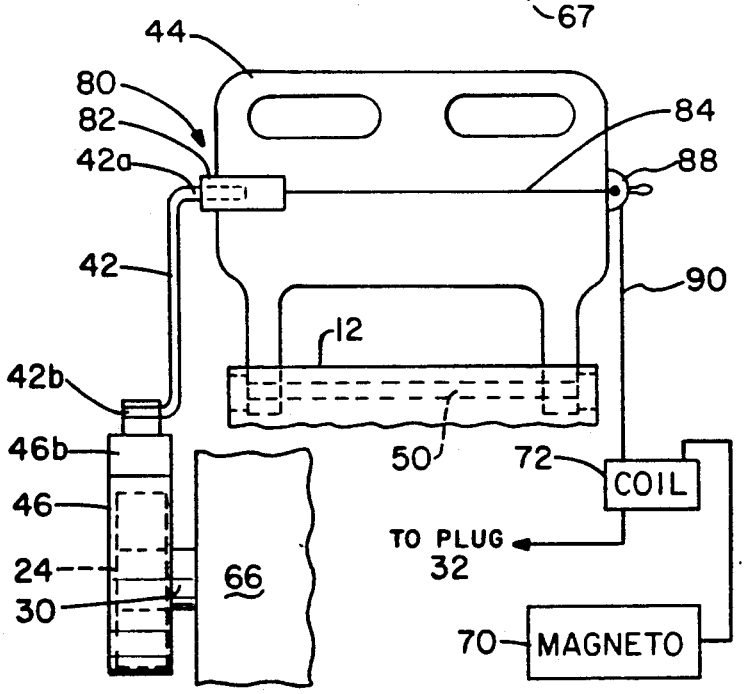
FIG. 4 is a frontal partial elevational view of a chain saw illustrating the various elements which comprise a chain brake mechanism and a second embodiment of the safety switch comprising the present invention.

It will be recognized by those skilled in this art, that the configuration illustrated in FIG. 3 will preclude placing of the safety brake mechanism 40 in the "brake engage" position at the time of motor start-up. Very clearly, with the safety brake 40 in the "engage" position the coil 72 will be grounded to the motor housing 66 through the brake mechanism and no electrical current will appear at the spark plug electrodes. Thus, motor start-up cannot be initiated with the safety brake in the "brake engage" position A solution to this is illustrated in FIG. 4 of the drawings which is a front elevational view of the chain saw 10, i.e., from the chain guide bar end. Of course, only a portion of the saw housing 12 is illustrated and only a portion of the motor housing 66 is shown and various other elements are only schematically illustrated. As shown, the brake lever 42 is in contacting engagement with the switch contact 82 which is fixedly mounted to the side recess 52 of the safety guard 44. In this embodiment of the invention which is designed such that the saw motor 11 may be started with the safety brake 40 being in the "brake engage" position, the wire conductor 84 from the switch contact 82 is connected into a switch 88 at the opposite end of the safety guard 44. A wire conductor 90 interconnects the switch 88 to the coil 72 and from this it can be appreciated that, when the switch 88 is in the "open-circuited" position, the ground circuit to the motor housing 66 is also open-circuited and the motor 11 may be started.

The position of the switch 88 on the operator's left hand side of the saw 10 is advantageous in that he may engage the safety brake 40 by moving the safety guard 44 in the forward direction and at the same time he may move the switch 88 to the "open-circuited" position for motor start-up. After the motor has reached idle speed and the clutch 26 prevents chain motion, the operator may move the safety guard 44 back to the "brake disengage" position and at the same time move the switch 88 to the "close-circuited" position. This may be accomplished using one hand while the operator's other hand remains on the rear handle 18 to control motor functions.

Referring now to FIGS. 5 and 6 of the drawings, a preferred embodiment of the invention is illustrated as it comprises a switch means 110 for shutting down chain saw motor operation at substantially the same instant that a chain brake mechanism is engaged. The switch means 110 is affixed to the safety guard 44 and it comprises a momentary contact type electrical switch which is normally biased in an "open-circuited" condition. The switch 110 is relatively mounted on the safety guard 4 such as to be rendered "close-circuited" by at least three different actions.

Firstly, the switch means 110 may be operated automatically by an engagement with the operator's hand 102 when saw kickback occurs. In this operational situation, the saw will rotate about the top handle 22 which is grasped by the operator. This rotation causes the operator's hand 102 to contact the safety guard 44 in a forceful manner such that the guard is moved in the direction of arrow $A_1$ as was hereinbefore described. Movement of the safety guard 44 in the direction of arrow $A_1$ effects chain brake engagement via the chain brake lever 42. The safety switch means 110 is mounted in a position such that, when the operator's hand 102 engages the safety guard 44, it must first contact the switch means 110 which is "close-circuited" by the contact. Thus, the chain saw motor operation is effectively shut down at substantially the same instant that chain brake engagement is effected Secondly, the switch means 110 may be operated by the operator by merely pulling back on the safety guard 44 in the direction of arrow A2 The switch means 110 is mounted in a position such that it makes contacting engagement with the top handle 22 when the operator's hand 102 is not grasping the handle and this effects motor shut-down by the close-circuited action of the switch.

Thirdly, the switch means 110 may be operated by the operator at any time by merely pushing in on the top button portion 112 which forms a primary functioning element of the switch means 110. This may be done without engaging the chain brake mechanism via the safety guard 44 inasmuch as the force necessary for chain brake engagement greatly exceeds the force required to operate the momentary switch means 110.

As illustrated generally in FIG. 5, the switch means 110 comprises a momentary contact type switch having a button end 112 which effects operation of the switch. The switch also has a body portion 114 which is affixed to the safety guard 44 by various known methods and/or techniques. For example, the safety guard 44 conventionally comprises a substantially hard rubber or other type of polymeric material and the switch means 110 may be potted within the material at the time of manufacture. Alternatively, a bore 44*a* may be formed or drilled into the material such that the switch means 110 may be positioned within the bore and maintained therein by way of a suitable adhesive or the body portion 14 of the switch may be threaded to carry a backing nut in the conventional manner of such type switch mountings. In any event, the switch means 110 includes an electrical conductor 116 which is connected to a ground potential, i.e., the chain saw motor housing 66 A second electrical conductor 118 is also provided and it is connected to the coil 72 in the same manner as hereinbefore described. In this configuration, a single 2-wire conductor lead 120 may be used for connecting the switch means 110 to the coil 72 and ground 66 both of which ar located within the saw housing 12.

Referring to FIG. 6 of the drawings, a particular switch means 110 is illustrated. The switch means 110 comprises a body portion 114 that is mounted and affixed to the safety guard 44 in any of the well-known techniques alluded to. The switch means 110 has a substantially closed bottom end 122 which has a pair of electrical contacts 124*a* and 124*b* mounted therein in a spaced position relative to each other. Electrical contact 124*a* is connected to a lead wire conductor 126 which has its opposite end connected to ground potential, i.e., the motor housing 66. Electrical contact 124*b* is connected to a lead wire conductor 128 which has its opposite end connected to the coil 72. The switch means 110 has a movable contact member 130 that is affixed to the button end 112 by way of a tubular stem portion 132. The tubular stem portion 132 carries a spring member 134 within its bore, which spring member biases the movable contact 130 in a normally "open-circuited" position as shown in the drawing. Obviously, a force in the direction of arrow $A_3$ will effect an electrical interconnection as between the contacts 124*a* and 124*b* by way of the contact 130. In this condition of the switch means 110, the coil 72 will be grounded to the motor housing 66 and all motor operation will cease.

In some known configurations of the saw safety guard 44, there may be a metallic insert 140 potted within the material comprising the safety guard body and such insert is shown in drawing by way of dot-dashed ghost lines. In this respect also, the metallic insert 140 will be carried by the mounting pin 50 which allows for rotational motion of the safety guard. It will, of course, be recognized that the metallic insert 40 provides an advantageous ground connection for the switch means 110 when the mounting pin 50 is carried by a flange or like member of the motor housing 66. The switch means 110 may thus have its electrical contact 124*a* connected to the insert 40 by way of a short lead wire conductor 142 (shown in ghost lines) and only a single wire conductor 128 is necessary for the electrical connection to the coil 72.

Alternatively, the switch means 110 may be configured such that the conductor contact 130 effects a direct interconnection as between the metallic insert 140 and the electrical contact 124*b*. This is, of course, all within the knowledge and abilities of persons working in the electrical switching arts. The invention, therefore, is not considered limited in any way or manner to the specific configuration of the switch means 110; suffice to say that it comprises a momentary "close-circuited" electrical switch which is normally biased in an "open-circuited" condition of such type switches.

It will, of course, be recognized that the switch means 110 effectively removes the necessity of the on/off switch 34 which is conventionally located at the rearward end of the saw in close proximity to the handle 18. Switches 34 of the prior art may be of various configurations and most of these suffer the same defect, i.e., they do not shut down the saw motor operation automatically the instant that the chain brake is engaged due to a hazardous operating condition. Furthermore, switches of the type 34 are conventionally more complicated in structure and therefore they are more costly and require more complicated installation techniques.

Thus, this invention provides a marked improvement in chain saw safety in the art and it is low in cost and very readily adapted and mountable to most presently used saws in the field as well as being applicable to all newly designed gasoline-powered chain saws.

While certain representative embodiments and details of the invention have been shown for the purpose of illustrating the invention, it will be apparent to those skilled in this art that various changes and modifications may be made thereto without departing from the spirit or scope of the invention.

What is claimed is:

1. A safety switch for a chain saw having a gasoline-powered motor driving a cutting chain about a chain guide bar through a shaft-mounted sprocket hub, said motor having a spark generating means receiving an electrical current from an electrical power generating means, a housing with a top handle thereon, and a movable safety guard pivotally attached to the housing and spaced in a forward direction from the top handle, the safety switch comprising in combination:

a chain brake mechanism having a brake actuator operatively interconnecting the movable safety guard with a brake mounted in association with the sprocket hub, said brake actuator being movable to and from a brake release position and a brake engage position with the sprocket hub by movement of the safety guard, backward toward the top handle and forward away from the top handle;

an electrical switch mounted on the safety guard and actuated in response to forward pressing of a hand of a saw operator simultaneously against the electrical switch and the safety guard; and electrical conductor means connecting the electrical power generating means and the motor housing through the electrical switch, said electrical switch when close-circuited providing an electrical ground connection to the motor housing to shut down the motor as the brake is being actuated.

2. The safety switch as claimed in claim 1 wherein the brake actuator is moved to the brake engage position when the safety guard is moved forward away from the top handle and is moved to the brake release position when the safety guard is moved backward toward the top handle.

3. The safety switch as claimed in claim 1 wherein a first switch contact of the electrical is electrically connected to the power generating means and a second switch contact is mounted in close proximity to the first switch contact and electrically connected to the motor housing.

4. The safety switch is claimed in claim 3 wherein a movable electrical conductor member makes contacting engagement with both the first switch contact and the second contact when the safety guard is moved in a backward direction toward the top handle.

5. The safety switch as claimed in claim 1 wherein the electrical switch comprises a momentary type contact switch which is biased in a normally open-circuited position, said electrical switch being fixedly mounted to the safety guard such as to be temporarily operably close-circuited by contact with the hand of the saw operator while said hand is simultaneously moving the safety guard in a forward direction away from the top handle.

6. The safety switch as claimed in claim 5 wherein a first switch contact of the electrical switch is electrically connected to the power generating means and a second switch contact is electrically connected to the motor housing.

7. The safety switch as claimed in claim 5 wherein the electrical switch comprises a spring biased button contact positioned to electrically interconnect a first switch contact electrically connected to the power generating means and a second switch contact electrically connected to the motor housing, said electrical switch being mounted to the safety guard such that the button contact may be selectively operated by a saw operator to close-circuit the first and second switch contacts.

8. The safety switch as claimed in claim 7 wherein the second switch contact of the electrical switch is electrically connected to the motor housing through a pivot mounting of the safety guard.

9. An electrical all-stop safety switch for a chain saw having a gasoline-powered motor driving a cutting chain about a guide bar through a shaft-mounted sprocket hub, said motor having a spark plug ignition receiving an electrical current from a magneto generator through a coil, chain braking mechanism associated with the sprocket hub and engageable by a safety guard through a brake actuator, and a housing with a top handle thereon, said safety guard being pivotally attached to the housing and spaced forward from the top handle, said safety switch comprising in combination:

a switch housing fixedly mounted to the safety guard;

a movable electrical contact mounted within the switch housing and having a button end spring biased to extend outwardly from the switch housing and rearwardly toward the top handle;

a first electrical contact mounted within the safety guard in relative operable position to the movable contact and electrically connected to the motor coil; and a second electrical contact mounted within the safety guard in relative operable position to both of the movable and first electrical contacts and electrically connected to the motor housing;

said safety switch being normally open-circuited by the spring-biased movable contact but which is rendered close-circuited when the hand of a saw operator presses the button end of the movable electrical contact such that the spark ignition is short-circuited to the motor housing to effectively stop all motor operation.

10. The safety switch as claimed in claim 9 wherein the switch is rendered close-circuited by a selective action of a saw operator on the button end of the movable contact without effecting chain braking action by the safety guard.

11. The safety switch as claimed in claim 9 wherein the saw safety guard has a metal insert within the material forming the guard body and the insert effects a metallic interconnection to the motor housing through a pivot pin mounting and the second electrical contact of the safety switch is electrically connected to the insert.

12. A safety switch for a chain saw having a housing with a top handle thereon, a movable safety guard pivotally attached to the housing and spaced forward from the top handle, a gasoline-powered motor driving a cutting chain about a chain guide bar through a shaft mounted sprocket hub, a chain brake mechanism mounted in association with the sprocket hub and movable to and from a brake release and a brake engaged position with the sprocket hub, brake actuation means interconnecting the brake mechanism with the safety guard so that movement of the safety guard in one direction will move the brake mechanism to the brake release position and movement of the safety guard in the opposite direction will move the brake mechanism to a brake engage position, and a spark generating means receiving an electrical current from an electrical generating means, the safety switch comprising;

an electrical switch mounted on the movable safety guard and movable therewith toward and away from the top handle, the electrical being biased in a normally open position;

the electrical switch having an actuating member extending outwardly toward the top handle for temporarily closing the electrical switch when pressure is applied to said actuation member by a hand of a saw operator, the electrical switch being connected into an electrical circuit between the electrical power generating means and the motor housing, said electrical switch when close-circuited providing an electrical ground connection to turn off the motor, said ground connection being broken when the electrical switch is in the open-circuited position to permit the motor to run.

13. The safety switch as claimed in claim 12 wherein the electrical switch remains open-circuited to permit the motor to run in either the brake release or the brake engage position.

14. The safety switch as claimed in claim 12 wherein the electrical switch is moved to the closed-circuited position by moving the safety guard backwards toward the top handle until the actuation member bears against and is depressed by the top handle.

15. The safety switch as claimed in claim 12 wherein the actuation member of the electrical switch is manually depressed with or without moving the safety guard to a position wherein the brake mechanism is in the brake engage position.

16. The safety switch as claimed in claim 12 wherein movement of the safety guard into a forward position away from the top handle will move the brake mechanism to a brake engage position and movement of the safety guard into a backward position toward the top handle will move the brake mechanism to a brake release position.

17. In a chain saw having a gasoline motor driving a cutting chain, an electrical ignition system, a housing with an upwardly extending handle, and a safety guard movable toward and away from the handle to move a chain brake respectively into either a brake release position or a brake engage position, a safety switch means comprising:

a normally biased open momentary switch mounted on the safety guard in a location adjacent to the handle and connected into a circuit for grounding the ignition system when the switch is momentarily closed, said switch having an actuator button facing toward the handle for contact with the handle when the safety guard is pulled toward the handle or for contact with a hand of a saw operator holding the handle in case of saw kick back or for contact with the hand of the saw operator when the hand is simultaneously pressed against the button and the safety guard to move the guard away from the handle and thereby move the chain brake into the brake engage position.

* * * * *

UNITED STATES PATENT OFFICE

CERTIFICATE OF CORRECTION

Patent No. 5,101,567 Dated Apr. 7, 1992

Inventor(s) James E Cool

It is certified that error appears in the above-identified patent and that said Letters Patent is hereby corrected as shown below:

Column 1, line 58, after "provided" insert--. Chain brake devices of this type are disclosed in the prior --.

Column 5, line 1, "pug" should read --plug--.
Column 7, line 1, the numeral "4" should read --44--.
Column 7, line 22, "A2" should be followed by a period --(.)--.
In the claims, Column 9, line 33, the word "electrical" should be followed by --switch--.
Column 9, line 38, the word "is" should be --as--.
Column 10, line 65, the word "electrical" should be followed by --switch--.
Column 7, line 22, "A2" should read --$A_2$--.

Signed and Sealed this

Seventeenth Day of August, 1993

Bruce Lehman

*Attest:*

BRUCE LEHMAN

*Attesting Officer*

*Commissioner of Patents and Trademarks*